US005402906A

United States Patent [19]

Brown et al.

[11] Patent Number: 5,402,906

[45] Date of Patent: Apr. 4, 1995

[54] FRESH PRODUCE CONTAINER SYSTEM

[76] Inventors: Richard S. Brown, 34325 Chualar Canyon Rd.; Bennett W. Brown, 34021 Chualar Canyon Rd., both of Chualar, Calif. 93925

[21] Appl. No.: 260,397

[22] Filed: Jun. 14, 1994

Related U.S. Application Data

[63] Continuation of Ser. No. 952,370, Sep. 28, 1992, abandoned, which is a continuation-in-part of Ser. No. 915,093, Jul. 16, 1992, Pat. No. 5,354,569.

[51] Int. Cl.[6] ..... B65D 5/60

[52] U.S. Cl. ..... 220/403; 206/524.8; 220/410; 229/109

[58] Field of Search ..... 220/403, 408, 410, 420, 220/425, 461, 462, 468; 229/23 R, 109, 110; 206/386, 524.8; 426/124

[56] References Cited

U.S. PATENT DOCUMENTS

| | | | |
|---|---|---|---|
| 3,261,533 | 7/1966 | Repking | 229/109 |
| 3,419,400 | 12/1968 | Hayhurst et al. | 426/124 |
| 3,450,542 | 6/1969 | Badran | 426/124 |
| 3,521,806 | 7/1970 | Esty | 220/461 |
| 3,945,558 | 3/1976 | Elder | 229/109 |
| 3,957,179 | 5/1976 | Bamburg et al. | 229/109 |
| 4,079,152 | 3/1978 | Bedrosian et al. | 426/124 |
| 4,089,417 | 5/1978 | Osborne | 229/109 |
| 4,105,153 | 8/1978 | Locke | 229/109 |
| 4,268,555 | 5/1981 | Kantz | 206/386 |
| 4,296,860 | 10/1981 | Hsu et al. | 229/23 R |
| 4,343,429 | 8/1982 | Cherry | 229/109 |
| 4,423,080 | 12/1983 | Bedrosian et al. | 426/124 |
| 4,516,692 | 5/1985 | Croley | 220/403 |
| 4,610,885 | 9/1986 | Tait | 220/462 |
| 4,702,408 | 10/1987 | Powlenko | 229/109 |

FOREIGN PATENT DOCUMENTS

| | | | |
|---|---|---|---|
| 1025786 | 2/1978 | Canada | 220/403 |
| 2842204 | 4/1980 | Germany | 206/386 |
| 402436 | 12/1933 | United Kingdom | 229/23 R |

OTHER PUBLICATIONS

"The King PAK" eight sided fiberboard IBC from Packaging Review, May 1980, (1 page).

The Wiley Encyclopedia of Packaging Technology (WFPT), John Wiley & Sons, p. 493, (1986).

*Primary Examiner*—Gary E. Elkins

*Attorney, Agent, or Firm*—Robert J. Schaap

[57] ABSTRACT

A packaging system for fresh produce such as fresh lettuce and like food products. The packaging system relies upon a quadrilaterally shaped, fairly rigid paperboard container having more than four corner portions therein and with an inner liner used for the storage and transport of produce, such as lettuce heads. In a preferred embodiment, the containers are octagonally shaped with four rectangularly shaped elongate walls connected at their corner portions by four relatively short angularly located connecting walls. Portions of these containers, and particularly the expensive side walls, are capable of being reused. Moreover, they are uniquely adapted for storage and transport in stacked relationship and also are designed so as to fit upon conventional pallets.

13 Claims, 2 Drawing Sheets

FRESH PRODUCE CONTAINER SYSTEM

RELATED APPLICATION

This application is a continuation of application Ser. No. 952,370, filed Sep. 28, 1992, for Fresh Produce Container System and Method, now abandoned, which is a continuation-in-part of U.S. patent application Ser. No. 915,093, dated Jul. 16, 1992, for "Environmentally Controlled Packaging for Produce and Method and Use Therefor", now U.S. Pat. No. 5,354,569.

BACKGROUND OF THE INVENTION

1. Field of the Invention

This invention relates in general to certain new and useful improvements in a container system for the storage and transport of fresh leafy vegetables and more particularly, to a storage and transport system and associated method which permits storage of bulk quantities of such vegetable produce in large stackable paperboard containers and which also reduces the problems of deterioration and spoilage.

2. Brief Description of the Prior Art

Vegetables, such as lettuce, and other produce are frequently shipped to a processing facility from a farm site to a processing facility and often from a processing facility to a site of use in paperboard containers. However, lettuce heads and like produce often contain substantial amounts of entrained water and which leaves the vegetable heads in the form of sap or through evaporation through the leaves. The moisture from this produce penetrates the side walls of the paperboard container, thereby weakening the container often causing a premature rupture or tear of the container during transport. In such a case, if the container ruptures during transit, the entire container and the produce contained therein may be discarded, thereby resulting in loss.

In addition to the above, the moisture from the fresh produce, and particularly fresh leafy produce such as lettuce heads and the like, often penetrates the paperboard containers and wets the containers which further harbors and promotes bacterial growth. The only known technique for reducing the bacterial growth and maintaining the vegetable product in a fresh state is to store and ship the fresh vegetable products in a reduced temperature environment. While this may inhibit bacterial growth, it does not eliminate such growth.

Due to the foregoing problems, in order to ship fresh leafy vegetable products, the containers have had to be of a fairly thick and substantial construction. While this does reduce some of the rapid deterioration from water released from the produce, it does not overcome the bacterial growth problem. Moreover, the very fact that the containers are of a more durable construction substantially increases the weight and hence, the overall transport cost of the containers. Due to the fact that many of these vegetable products must be transported for a period of several days, e.g., six or more days, the containers must be of sufficient durability to maintain their structural integrity for this transit period.

In the prior art, fresh leafy vegetables, such as lettuce heads and the like, are generally transported in rectangularly shaped paperboard containers. Moreover, these paperboard containers are usually of a disposable construction. Due to the fact that these containers are usually disposed of at a site of use, the overall cost of storage and transport is increased and moreover, there is the resultant problem of disposing of the used paperboard containers, not to mention the environmental impact resulting therefrom. In addition to the foregoing, these containers are often punctured by nails in pallets during storage and other transit. This misuse and rough handling further militates against the reuse of the containers.

It is well known that heads of lettuce deteriorate rapidly in the presence of oxygen. It is therefore desirable to store and transport the lettuce in a relatively oxygen-free environment. There have been attempts to package heads of lettuce in relatively small quantities (e.g. six to eight heads of lettuce) in a plastic bag which is then sealed with a relatively inert atmosphere such as carbon monoxide. However, these packaging techniques are used for specific purposes where only a very small quantity of the vegetable product is transported.

In our co-pending U.S. patent application Ser. No. 915,093, filed Jul. 16, 1992, there is provided both a container system and a method for transporting of fresh vegetable products, such as leafy head lettuce and the like, in a liner located in a reusable paperboard container. Also, in this aforesaid patent application, there is also provided an embodiment wherein a pair of plastic liners are used with lettuce stored in an inner plastic liner which is then sealed and charged with an oxygen rare atmosphere and where the space between the inner and outer liner is also charged with an oxygen rare atmosphere. This type of packaging system and method has been effective for reducing the deterioration and discoloration of lettuce products at a destination.

This packaging system and method in the aforesaid U.S. patent application also reduces the attendant labor costs for removing the discolored or deteriorated outer leaves of lettuce heads. The process and container system of the aforesaid patent application is effective so that lettuce heads and like food products can be cored, that is, have the center cores removed, at a farm site where lower labor cost is generally available. In this way, the farm-fresh produce can reach a site of destination where it is not necessary to core the lettuce with substantially higher labor costs.

One of the problems attendant to the shipping and transport of lettuce is the fact that it is necessary to transport the lettuce in large containers and moreover, to provide containers of durability so that they are stackable on one another. In many cases, several hundred heads of lettuce must be stored in a single container and this container itself can weigh up to eight or nine hundred pounds. When one or more like containers are stored on a container of this construction, it is apparent that there is a substantial and compressive load on the lowermost container. Thus, this lowermost container must be of a construction to withstand the weight of the containers stacked thereon. However, resort to a thicker sidewall construction of the container only increases the overall thickness of the container and hence, the overall weight which is transported.

In addition to the above, it is necessary for any container to generally have a size and shape which will conform to a pallet upon which the container itself may be stored. In most cases, the pallets are of a wood construction and are usually rectangular, if not square, in shape. As a result, any construction must conform to and generally achieve a rough marginal registration with the upper surface of a pallet.

Octagonally-shaped containers having four elongate side walls connected by four relatively short length sidewalls, in an irregular octagonal arrangement, have been used for transporting of watermelons. Thus, and to that extent, octagonally shaped containers somewhat similar to those of the present invention have been used in the past. However, the octagonally shaped containers used for watermelons were severely limited in size and particularly in height. In fact, it has been found that these containers could have an overall height of no more than 36 inches. In many cases, the container had to be constructed with a height of less than 36 inches in order to withstand the weight of the watermelons.

In addition to the foregoing, the prior art containers used for transporting of watermelons had a relatively thick sidewall construction. As a result, the overall cost and weight of the container used to hold the watermelons was substantially increased. However, due to the fact that the watermelons themselves exhibited such substantial weight, the increase in weight from the extra thick wall of the container was not that significant. Contrariwise, the additional weight provided by an additional thickness of a sidewall construction would add materially to the overall weight of lettuce when being transported.

OBJECTS OF THE INVENTION

It is, therefore, one of the primary objects of the present invention to provide a packaging system for the storage and transport of vegetables in quantities of several hundred pounds or more and which permits the vegetables to be stored and transported in stackable and reusable paperboard containers.

It is another object of the present invention to provide a paperboard container construction for the storage and transport of fresh leafy vegetables and like produce which is capable of being used in a stacked relationship with like containers and without unduly increasing the overall thickness of the container sidewall construction.

It is a further object of the present invention to provide a packaging system of the type stated for use in the storage and transport of vegetables and in which the vegetables can be stored and transported without any significant deterioration or discoloration and without any substantial damage to the vegetable products.

It is additional object of the present invention to provide a packaging system of the type stated in which non-regular polygonal containers having at least six sides, and preferably having eight sides, are used and which provides the necessary corner column strength, size and shape so as to be stored on conventional rectangularly shaped pallets.

It is another salient object of the present invention to provide a method of transporting fresh leafy vegetables in paperboard containers which are stackable on one another and on conventional pallets.

It is still another object of the present invention to provide a method of transporting fresh leafy vegetables and like food products which is highly effective and which enables the storage and transport at a relatively low cost.

With the above and other objects in view, our invention resides in the novel features of form, construction, arrangement and combination of parts presently described and pointed out in the claims.

BRIEF SUMMARY OF THE DISCLOSURE

The present invention relates in general to a container system for the storage and transport of food products, especially leafy vegetables such as head lettuce and the like. While the present invention has been described in connection with the storage and transport of vegetables, it is nevertheless obvious that the container system of the invention and the process thereof is highly effective in the storage and transport of other food products.

The container system of the present invention generally relies upon an outer paperboard container which is comprised of a tubular sidewall or so-called "tube", along with upper and lower caps. Each of these upper and lower caps are provided with angularly struck flanges so as to tightly extend over the walls of the tube adjacent the upper and lower ends, and thereby fit onto the ends of the tube. In this way, staples or like fasteners are not required for securement of the caps to the tubular sidewall of the tube. Furthermore, no staples are used in the construction of the container.

The container is effectively reusable, although in some cases the caps can be damaged by virtue of sliding on wooden pallets or the like. Even though the caps may be replaced, the tubular sidewall or tube, which is the more expensive portion of the container, is capable of being reused for a large number of shipments.

The outer paperboard containers are generally polygonal in shape and moreover, they are of a non-regular polygonal shape such as an irregular hexagonal shape or an irregular octagonal shape. It is preferable to have at least five corners and even more preferable to have at least six corners in the construction of the container sidewall. The most preferred construction is that of an octagonally shaped container where there are effectively eight corners.

The octagonally shaped container and, for that matter, the other polygonal containers used in the present invention are of an irregular -shape. The sidewall is formed of elongate sidewall sections, that is, the sidewall sections are elongate in a horizontal dimension in the container, and relatively short sidewall sections. Thus, in the case of the octagonally shaped container, there are four elongate side wall sections which are located in a generally rectangular array. Each of these elongate sidewall sections are connected by relatively short sidewall sections. Here again, four relatively short side wall sections extend between each of the elongate side wall sections.

The relatively short sidewall sections are also located in a rectangular array relative to one another. However, the relatively short sidewall sections are angularly displaced at an angle of about 45 degrees with respect to the relatively long elongate sidewall sections.

In accordance with the above-outlined construction, it can be seen that there are effectively four pairs of corners which serve as corner column sections. Thus, there is generally a rectangular array of two corner columns at each corner of this somewhat rectangular array.

By use of a container sidewall and with a bottom section and lid of the aforesaid construction, these containers are capable of being effectively stacked on pallets, such as wooden pallets, having a rectangular shape. The elongate sidewall sections of the container generally conform to and generally do not extend over the edges of the wooden pallet. Thus, a pair of corner sections of the container is located in proximity to each corner of the rectangularly shaped pallet. By this construction, the container itself, although of an octagonal shape, actually operates, for stacking purposes, as a generally rectangularly shaped container. Nevertheless, it affords the additional structural integrity of eight corners or eight columns, as opposed to four corners or four columns in a rectangular paperboard construction.

These corner portions of the tubular container are the portions which transmit the vertical loads. Since these loads are distributed over the eight corners, as opposed to four corners in a quadrilateral container, it is now possible to stack several of these containers on top of one another when fully loaded and on top of a rectangularly shaped pallet.

In one embodiment of the invention, a foldable flexible liner, such as a plastic liner, is inserted into the outer paperboard container and this liner has a low oxygen transpiration rate and therefore, is nearly impervious to air. However, there is at least some oxygen migration into the interior of the liner. This, in effect, provides some breathability to the liner film, permitting an oxygen transmission back and forth. The liners are constructed preferably of polyethylene or like material and having a thickness of about three to four mils which is substantially thicker than the approximate two mil thickness used in the prior art packaging of lettuce.

It has been found that a very slow migration of oxygen into the interior of the liner is actually helpful in maintaining a freshness of the lettuce or other produce. While the lettuce will wilt in the presence of a substantial amount of oxygen, a relatively small amount of oxygen obtained by the very low transpiration rate has actually been found to be beneficial.

The liner is sized to receive the heads of lettuce in large quantities. Thereafter, when filled, a small hole is punctured in the liner and air is evacuated therefrom. After the flushing of air, the liner is then directly sealed and filled with an inert atmosphere, such as a high carbon monoxide or nitrogen content atmosphere, and the opening is also sealed.

Prior to the evacuating and recharging of a new atmosphere in the liner, the upper end of the liner is rolled over and sealed to the side wall so as to provide a complete air-impervious inner chamber which receives the lettuce or other vegetable product.

In a more preferred embodiment, a pair of plastic liners are inserted in each of the outer paperboard containers and both of the liners are generally gas-impervious and particularly, impervious to air. One of the plastic liners is located within the other so as to provide an inner liner and an outer liner. The heads of lettuce are stored in large quantities in the inner liner. In some cases, several hundred heads of lettuce are located in each container. After the container is filled, the upper end of the inner liner is then sealed in a manner to be hereinafter described. Thereafter, a small hole is punctured in the inner liner and air is evacuated therefrom. If desired, the inner liner can then be refilled with an inert atmosphere, such as a high carbon monoxide or nitrogen content atmosphere. The opening in the inner liner is then sealed as, for example, by a piece of tape or the like.

After sealing of the inner liner, the outer upper ends of the outer liner are then rolled together and sealed so as to form an air-tight chamber surrounding the inner liner. Again, a small opening is made in the outer liner and the air is evacuated from the outer liner and replaced with an inert atmosphere containing a high percentage of carbon monoxide or nitrogen gas. Again, the small opening in the outer liner is then sealed. After completely sealing the atmosphere within each of the liners, the upper cap is located on the upper end of the tube or tubular side wall.

In the packaging arrangement as previously described, the lettuce can remain, as long as refrigerated, for a substantial period of time since it will not wither or deteriorate as a result since there is no oxygen exposure. Moreover, since the containers themselves contain virtually no metal pieces, there is little or no risk of puncturing the inner or the outer liners within the paperboard container. As long as there are no large protruding objects such as long nails extending beyond the wooden palate, then the packaged lettuce remains in a environmentally controlled atmosphere.

Moreover, since the heads of lettuce are contained with one or more waterproof plastic liners, there is little or no chance for water or lettuce sap damage to the outer paperboard container and which previously resulted in a large portion of the damage or contamination to the containers. Consequently, the containers, and particularly the cardboard portions thereof, can be reused on several occasions for the storage and transport of additional loads of lettuce.

By utilizing the packaging technique heretofore described, it is now possible to literally ship lettuce prepared at a site near a farm area and transport the same in a ready condition for use to a location thousands of miles in distance from the site of growing and initial processing. Thus, the lettuce can be cored and with any outer layers removed at the processing plant near the farm site before shipping. Thus, when the heads of lettuce reach their destination, they are almost immediately ready for use in shredding or chopping operations or preparation.

As mentioned above, one of the concerns encountered in the storage and transport of lettuce are metal fragments. It has been found that by sealing the outer margins of the plastic liners with a releasable tape, that there is no need for knives, razor blades or the like to open the liners. The workers who require access to heads of lettuce can merely pull the strips of adhesive tape from the bags thereby affording immediate access. Knives or razor blades are not present to accidentally fall into slicing equipment and therefore, the final salad.

The present invention possesses many other objects and advantages which will become more fully apparent from a consideration of the forms in which it may be embodied. One of these forms is shown in the accompanying drawings and described in more detail in the following detailed description of the invention. However, it is to be understood that these drawings and the detailed description are set forth only for purposes of illustrating and describing the general principles of the invention and are not to be taken in a limiting sense.

BRIEF DESCRIPTION OF THE DRAWINGS

Figure 1:
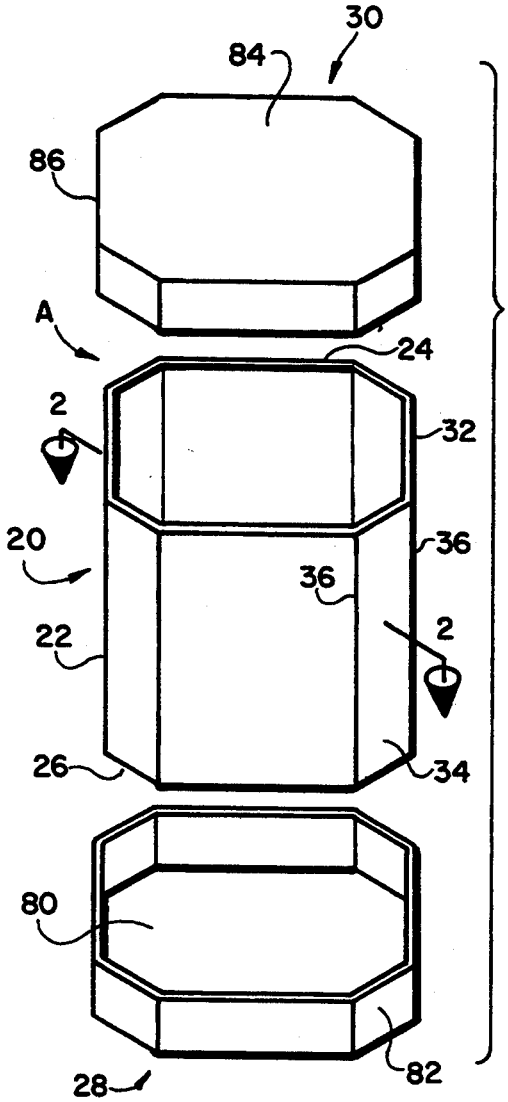
Figure 2:
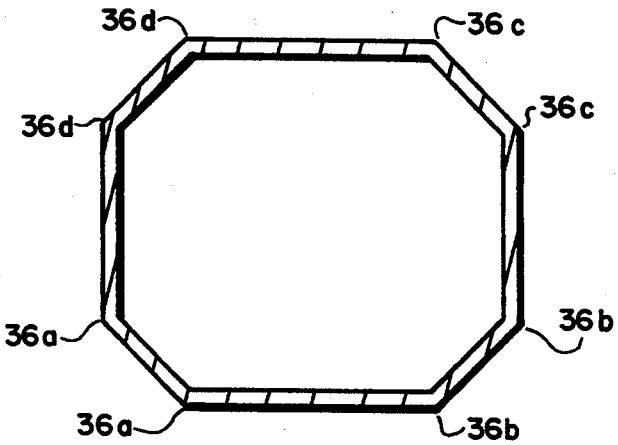
Figure 3:
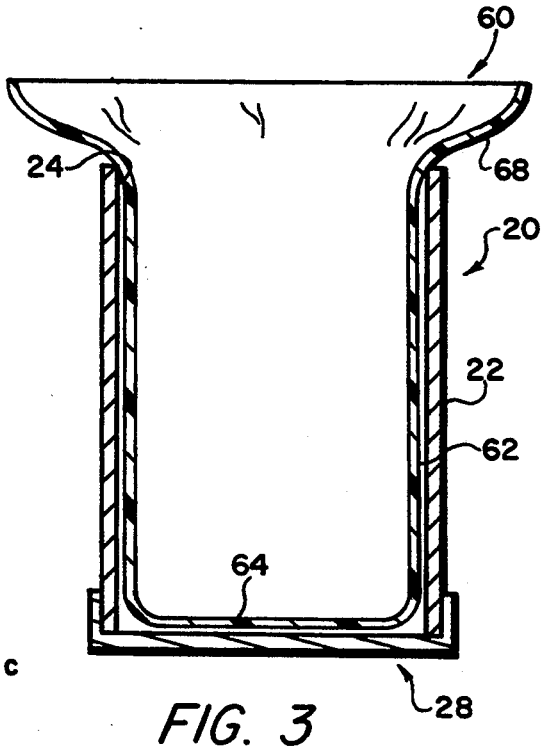
Figure 4:
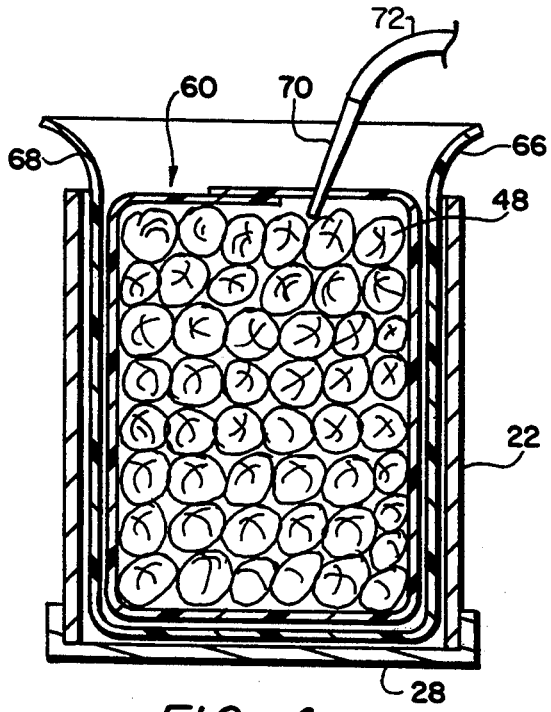
Figure 5:
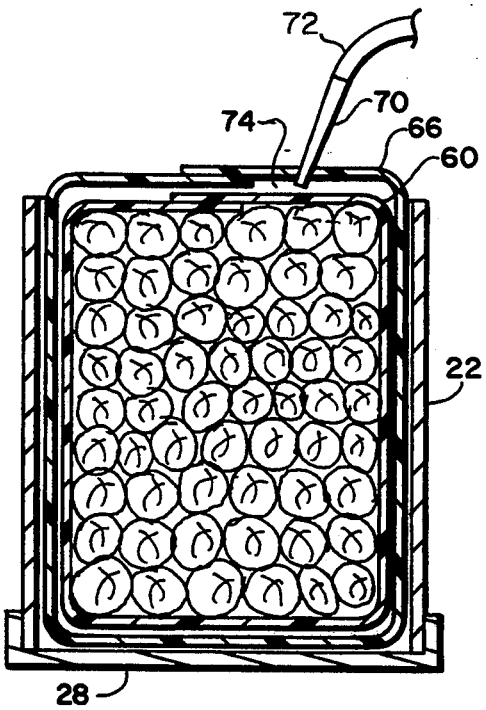
Figure 6:
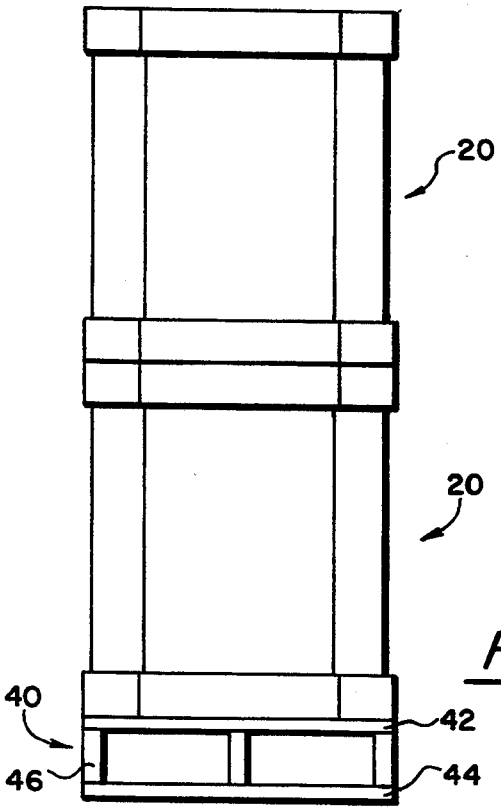
Figure 7:
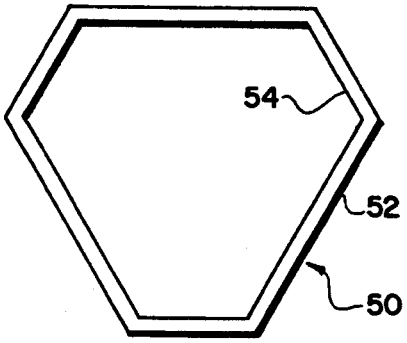

Having thus described the invention in general terms, reference will now be made to the accompanying drawings in which:

FIG. 1 is an exploded perspective view of a container assembly used in the container system of the present invention;

FIG. 2 is a horizontal sectional view taken along line 2—2;

FIG. 3 is a vertical sectional view showing the use of an outer paperboard container with an inner liner disposed therein;

FIG. 4, is a vertical sectional view, somewhat similar to FIG. 3, and showing one step involved in the evacuation of the atmosphere of a plastic liner having head lettuce stored therein;

FIG. 5 is a vertical sectional view, somewhat similar to FIG. 4, and showing the insertion of a needle to inject a modified atmosphere in a sealed liner forming part of the container assembly of the invention;

FIG. 6 is a side elevational view showing a pair of the container assemblies of the present invention stacked on a conventional pallet; and FIG. 7 is a horizontal sectional view, somewhat similar to FIG. 2, and showing a slightly modified form of container construction in accordance with the present invention.

DETAILED DESCRIPTION OF PREFERRED EMBODIMENTS

Referring now in more detail and by reference characters to the drawings which illustrate several practical embodiments of the present invention, A designates a container assembly comprised of an outer carton 20 or so-called "container" having a continuous polygonal sidewall 22, and preferably an octagonally shaped side wall 22 with an opened upper end 24 and an initially opened lower end 26. A bottom section 28 is provided for attachment to the continuous sidewall 22 and an upper lid 30 is provided for removable disposition over the opened upper end 24 of the continuous sidewall 22.

By reference to FIGS. 1 and 2, it can be seen that the outer container sidewall, while being of an octagonal shape, nevertheless is of an non-regular octagonal shape. In other words, some of the sidewalls of the octagonally shaped container have a length, as measured along the upper edge or the lower edge thereof, which is larger than some of the other sidewall sections. In the preferred construction of the present invention, the octagonally shaped container is comprised of four elongate sidewall sections 32 and four relatively short length sidewall sections 34. The elongate side wall sections 32 have a substantial length (as measured in a horizontal plane) compared to the relatively short length side wall sections 34, again, as measured along the upper or lower edge thereof.

By further reference to FIGS. 1 and 2, it can be observed that each of the elongate sidewall sections 32 lie in a generally rectangular array and if their ends were extended to connect to one another, they would form a truly rectangular tube. In like manner, the relatively short sidewall sections 34 also lie in a generally rectangular array and if their ends were extended (in absence of the elongate side wall sections 32), to connect to one another, the relatively short sidewall sections 34 would also form a rectangularly shaped tube.

In accordance with the above-identified construction, it can be observed that the sidewall of the container forms a tube having a pair of corner sections or columns 36 at each of the four corners of a quadrant. Thus, the container construction, as illustrated in FIGS. 1 and 2, has a first pair of corner sections or columns **36*a*, a second pair of corner sections or columns 36*b*, a third set of corner sections or columns 36*c* and a fourth set of corner sections or columns 36*d***. Again, the corner sections of each pair are relatively closely spaced to one another, such that the four pairs of corner sections lie in a generally somewhat rectangular array.

By reference to FIG. 1, it can be observed that the upper lid 30 is of a construction very similar to and has a size and shape so as to fit on the opened upper end 24 of the container side wall. In like manner, the bottom section 28 has a size and shape similar to that of the container sidewall so as to fit over the initially opened lower end 26 of the tube.

The outer carton 20 is generally formed from heavy paperboard material, such as corrugated cardboard materials. Materials of this type are usually effective in withstanding substantial loads and withstanding abuse of the type normally encountered in the transports of food products, such as vegetable, e.g., lettuce heads and the like. However, it can be appreciated that these containers will quickly lose their structural integrity if they should become water-saturated. Nevertheless, to the extent that the containers remain relatively free of water saturation, they are quite durable. Further, due to the fact that the sidewall 22 is of a polygonal shape of the type as described, and with a large number of sides and corners, this container is of sufficient strength to withstand the loading of several like containers, filled with food products, when stacked on one another.

Referring, for example, to FIG. 6, it can be observed that a pair of containers 20 are stacked upon a conventional pallet 40. Pallets of this type are usually constructed with an upper wooden flat plate 42, a lower wooden flat plate 44 and a plurality of transverse ribs 46 connecting the upper and lower plates 42 and 44. However, any type of conventional pallet may be employed.

Due to the fact that each of the containers have four pairs of corner margins, in the manner as aforesaid, these containers effectively sit on a generally rectangularly shaped pallet. If the four elongate sidewall sections 32 were extended to connect to one another, then the container itself would effectively lie in marginal registration with the conventional pallet 40, except for corner portions. However, in order to obtain the increased strength to withstand compressive loading, the octagonal shape is highly effective and provides the eight corner margins or columns which give the container the necessary strength.

The containers of the present invention have an overall size which is effective for stacking on one another. Thus, two or more containers may be stacked on one another and on top of a conventional wooden pallet 40. The containers are also constructed with a size so that when stacked, they will neatly fit within the trailer section of an over-the-road produce hauler.

As indicated previously, watermelons have been transported in somewhat similar containers. However, due to the heavy weight of the watermelons, the overall vertical dimension of the container was severely limited. In fact, it was found that the container used for the transporting of watermelons could have a height of no more than 36 inches. The containers of the present invention, are not constrained by the weight of the watermelons and hence, have a much greater height than the height of a conventional watermelon container. In this case, the containers can have a height of at least 40 inches or more. In many cases, the containers are 41 inches so that three like containers can be stacked on one another and just fit within the vertical dimension of a conventional trailer used for hauling produce and like food products.

Other polygonal side wall constructions could also be used in the present invention. In each case, there should be at least six corner margins, and the corner margins should exist in pairs as aforesaid. FIG. 7 illustrates a modified form of container 50 having three elongate sidewall sections 52 and three relatively short length sidewall sections 54 with one relatively short sidewall section 54 connecting to a pair of elongate sidewall sections 52, as shown. The remaining construction of this type of container 50 is similar to that previously described, although the octagonally shaped container is preferred due to the fact that it would effectively fit on a rectangularly shaped pallet.

Provided for disposition in the interior chamber formed by the outer continuous sidewall 22, is a plastic liner 60 which is preferably made of a foldable and bendable plastic material and preferably of material of sufficient thickness so that it is air-tight and essentially air-impervious and water-impervious. Thus, a polyethylene plastic liner, or the like, may be employed. However, numerous other types of plastics could also be used in the formation of this liner.

The plastic liner 60 is preferably constructed in the form of an extruded tube which has a continuous sidewall 64 and an enclosing bottom wall 65 in the manner as best illustrated in FIG. 3. However, the sidewall is gussetted along its vertical dimension and is provided with an enlarged, outwardly flaring upper end 66, as best illustrated in FIG. 3.

In a more preferred embodiment, a pair of liners are used so that there is an inner liner 60 along with an outer liner 68, the latter of which also has an outwardly flared upper end 69, as best illustrated in FIG. 4 of the drawings. When the single liner 60 is filled, or otherwise, when a pair of liners 60 and 68 are filled, the upper end 65 is sealed and a needle 70 is inserted into the sealed liner for evacuating the air therefrom through a tube 72 connected to a suitable pump. The atmosphere of the evacuated liner 60 may then be refilled with an inert atmosphere, such as a carbon monoxide or nitrogen atmosphere.

When a pair of liners are employed the outer liner 68 is sealed and the space between the pair of liners 74 is evacuated with the same needle 70 and tube 72 and recharged with a relatively oxygen-inert atmosphere. The procedure for sealing the upper ends of the liners 60 and 68 and evacuating the atmosphere and recharging same is more fully illustrated and described in the aforesaid co-pending patent application and is therefore, neither illustrated nor described in any further detail herein.

In connection with the present invention, it has been found that when the lettuce heads, or similar produce, is stored in a relatively oxygen-free environment, there is little or no deterioration and resultant oxidizing of the food products which would otherwise occur in an oxygen-rich atmosphere. Consequently, little or nor cleaning or outer leaf removal is required when the lettuce product reaches its destination. Furthermore, the provision of a pair of liners has been proven to be effective in that even if the outer liner should become punctured during the sealing or transport operation or storage, the inner liner 60 will generally remain intact.

The bottom section 28 is provided with a relatively flat bottom wall 80, having an upstanding rim 82, the latter of which fits snugly against the lower end of the continuous tubular polygonal sidewall 22. In like manner, the upper lid 30 has a flat top wall 84, with a downwardly struck rim. Again, the downwardly struck rim 86 conforms to the overall shape and size of the upper end of the tubular side wall 22 so as to fit snugly thereon. In accordance with this construction, there is no need for the use of metal fasteners or other kind of fasteners for securing the bottom wall section 28 or the upper lid 30 to the tubular sidewall. The snug-fitting peripheral downwardly struck rim 86 retentively holds the upper lid 30 and the rim of the bottom section 28 holds the bottom section on the tubular sidewall. Furthermore, since these containers are generally stacked upon pallets, the need for fasteners to secure the lower end 26 to the sidewall 22 is avoided.

In accordance with the present invention, it can be seen that fresh produce can be cleaned at the growing site, such as a farm site, where the lettuce is refrigerated, outer layers are removed, and the produce packaged and then shipped. In the case of head lettuce, it is not only possible to remove the few outer leaves, it is also possible to literally core the lettuce at the growing site, that is, to remove the center core. Here, again, the cost is further reduced by using relatively inexpensive labor at a farm site, as opposed to more expensive labor at a site of use. Due to the fact that the head lettuce will be packaged in an inert atmosphere, the center core can be removed without the fear of rapid deterioration which would otherwise result in an oxygen-containing atmosphere.

Heretofore, it has been virtually impossible to ship any large quantity of head lettuce of like produce for any significant distance and particularly, for any time other than a few hours, without incurring rapid deterioration of the lettuce leaves which were exposed to an oxygen-containing atmosphere. Now, with the provision of the container system of the present invention, it is possible to economically ship large quantities of produce and similar food products with the outer leaves removed and with lettuce heads cored and the like and which are fresh and ready for final salad processing at a destination.

Inasmuch as the outer leaves of the lettuce have been removed, and particularly since it is now possible to core head lettuce, a very substantial portion of the weight which was previously shipped and which had essentially no retail value, has now been eliminated. As a result of using the process and the container systems of the present invention, very substantial freight savings will be achieved. Further, the coring, that is, removing of the head core at a farm site, also eliminates the disposal problem in large metropolitan areas which also results in an increase in overall costs.

Thus, there has been illustrated and described a unique and novel fresh produce container system which utilizes a unique container construction formed of a paperboard material and which is capable of being stacked on one another for purposes of transport and storage and which is also effective for transporting and storing leafy vegetable products without deterioration which would otherwise result. The present invention thereby fulfills all of the objects and advantages which have been sought therefor. It should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention are deemed to be covered by the invention.

Having thus described the invention, what we desire to claim and secure by Letters Patent is:

1. A container system for both the storage and/or transport of fresh leafy produce, such that the produce can be stored and transported, said container system comprising:

a) a non-regular octagonally shaped paperboard container sidewall shell having a bottom and plurality of vertically arranged elongate sidewalls connected by relatively short connecting walls such that each of said elongate sidewalls is separated from another elongate sideway by a relatively short connecting wall thereby providing eight corner portions, each two of said corner portions being relatively close to one another and operating as a cooperative pair thereby increasing the loading capacity compared to that afforded by a single corner;

b) each of said elongate sidewalls being located in rectangular arrangement and each of said relatively short connecting walls being located in a rectangular arrangement which is ,angularly displaced from the arrangement of the elongate sidewalls;

c) a bottom wall having the same shape as the sidewall shell disposed over the bottom of the sidewall shell;

d) a top wall having the same shape as the sidewall shell provided for removable disposition over an open top of the sidewall shell to function as a lid, said shell and bottom wall and top wall constituting an outer shipping and storage carton;

e) a flexible and foldable liner disposed in said shipping and storage container and being sized to receive and hold a bulk quantity of fresh leafy produce said liner being formed of a plastic material having a low oxygen transpiration rate allowing only a small amount of oxygen migration into the interior chamber of the liner;

f) a fresh leafy vegetable produce stored in the plastic liner and being transportable therein;

g) said chamber being evacuated and recharged with an oxygen rare atmosphere so that the produce is stored in the oxygen rare atmosphere;

h) said corner portions acting as columns and providing sufficient compressive force to enable stacking of a plurality of said shipping containers for storage and transport, said corner portions also being located in proximity to corners of a rectangular pallet and the elongate walls generally conforming to the sides and the four ends of a rectangular pallet so that the shipping and storage container does not extend substantially beyond the edges of the pallet, thereby enabling the storage and shipping cartons to be stacked on one another and on the rectangular pallet in a stacked arrangement.

2. The container assembly of claim 1 further characterized in that said sidewall shell with the lower end section and the lid thereon has an overall height of at least forty inches.

3. The reusable container system of claim 1 further characterized in that the lid and the lower end section are also formed of a paperboard material.

4. The container assembly of claim 3 further characterized in that the side wall is formed of a corrugated paperboard material.

5. A container assembly for both the storage and/or transport of fresh leafy vegetable produce in bulk such that the produce can be stored and/or transported, said container assembly comprising:

a) an outer paperboard container comprised of a structural continuous sidewall and lower end wall and a removable lid providing access to an interior chamber;

b) said continuous sidewall being comprised of at least three elongate sidewall sections and connected by at least three relatively short sidewall sections with the elongate side wall sections connected by the relatively short side wall sections, thereby providing a large number of column-like corner sections to enable stacking a plurality of said containers for storage and transport;

c) a produce-receiving plastic liner located in the interior chamber of said container and being entirely closed except for an initially open upper end, said liner being formed of a material which has a low oxygen transpiration rate allowing only a small amount of oxygen migration into the interior of the liner;

d) a fresh leafy vegetable produce stored in the plastic liner and being transportable therein;

e) means for closing the initially open upper end of the liner thereby fully enclosing said liner after fresh produce has been stored therein to provide an air-tight interior chamber for the stored produce; and f) said chamber being initially evacuated of air and recharged with an atmosphere containing a substantially reduced amount of oxygen when said chamber has been sealed with the produce stored therein, so that the produce is stored in an atmosphere with reduced amount of oxygen and with additional small amounts of oxygen migrating into the interior chamber such that there is only a small amount of oxygen in the chamber sufficient to maintain the produce but reduce the amount of produce deterioration.

6. The container assembly of claim 5 further characterized in that there is a single liner in said container construction.

7. The container assembly of claim 6 further characterized in that a pair of liners are in said container construction with one of the liners disposed in the other of the liners, each of said liners being formed of a plastic material with a low oxygen transporation rate.

8. The container system of claim 7 further characterized in that a pair of exits between the liners of the pair and said space is evacuated.

9. A container system for both the storage and/or transport of fresh leafy produce, such that the produce can be stored and transported, said container system comprising:

a) a non-regular octagonally shaped paperboard container sidewall shell having a plurality of elongate vertically arranged rectangular sidewalls connected by relatively short vertically arranged rectangular connecting walls thereby providing eight corner portions;

b) each of said elongate side walls being located in a rectangular array and having the same width as one another, and each of said relatively short side walls also having the same width as each of the other of the relatively short side walls;

c) each of the corners at the vertical edges of said relatively short side walls being sufficiently close to one another so that the pairs of corners together act as a column thereby increasing the loading capacity compared to that afforded by a single corner, each of the pairs of corners also being located so as to be located at or in proximity to the corner of a rectangular pallet when the container is stacked on a pallet so that a plurality of containers can be stacked on one another and exhibit the necessary structural integrity when subjected to said loading;

d) a lower end section having the same shape as the sidewall shell disposed over the bottom of the sidewall shell;

e) a lid having the same shape as the sidewall shell provided for removable disposition over an open top of the sidewall shell to provide an outer shipping and storage container;

f) a produce-receiving plastic liner located in the interior chamber of said container and being entirely closed except for an initially open upper end, said liner being formed of a material which has a low oxygen transpiration rate allowing only a small amount of oxygen migration into the interior of the liner;

g) a fresh leafy vegetable produce stored in the plastic liner and being transportable therein;

h) means for closing the initially open upper end of the liner thereby fully enclosing said liner after receiving fresh produce therein to provide an airtight interior chamber for the stored produce; and i) said chamber being initially evacuated of air and recharged with an atmosphere containing a substantially reduced amount of oxygen when said chamber has been sealed with the produce stored therein, so that the produce is stored in an atmosphere with a reduced amount of oxygen and with additional small amounts of oxygen migrating into the interior chamber such that there is only a small amount of oxygen in the chamber sufficient to maintain the produce but reduce the amount of produce deterioration.

10. The container system of claim 9 further characterized in that said sidewall shell with the lower end section and the lid thereon has an overall height of at least forty inches.

11. The container system of claim 10 further characterized in that said shell with the lid and lower end section thereon has an overall height of forty-one inches.

12. The container assembly of claim 11 further characterized in that the lower end section is comprised of a relatively flat bottom wall and an upwardly struck peripheral flange which engages the lower end of the side wall shell eliminating the need for external fasteners to secure the end section to the sidewall.

13. The container assembly system of claim 12 further characterized that the side wall has an upper end and said lid is comprised of a relatively flat upper lid wall and a downwardly struck peripheral flange which engages the upper end of the side wall shell in removable relationship thereto without external fasteners.

* * * * *